US010044096B2

(12) United States Patent
Tsai et al.

(10) Patent No.: US 10,044,096 B2
(45) Date of Patent: Aug. 7, 2018

(54) MOBILE DEVICE AND MANUFACTURING METHOD THEREOF

(71) Applicant: HTC CORPORATION, Taoyuan (TW)

(72) Inventors: Tiao-Hsing Tsai, Taoyuan (TW); Chien-Pin Chiu, Taoyuan (TW); Hsiao-Wei Wu, Taoyuan (TW); Yi-Hsiang Kung, Taoyuan (TW); Li-Yuan Fang, Taoyuan (TW)

(73) Assignee: HTC Corporation, Taoyuan (TW)

( * ) Notice: Subject to any disclaimer, the term of this patent is extended or adjusted under 35 U.S.C. 154(b) by 0 days.

(21) Appl. No.: 15/292,272

(22) Filed: Oct. 13, 2016

(65) Prior Publication Data

US 2017/0033443 A1 Feb. 2, 2017

Related U.S. Application Data

(63) Continuation of application No. 14/666,450, filed on Mar. 24, 2015, now Pat. No. 9,502,773.

(51) Int. Cl.

| | |
|---|---|
| ***H01Q 1/24*** | (2006.01) |
| ***H01Q 13/10*** | (2006.01) |
| ***H01Q 9/04*** | (2006.01) |
| ***H01Q 9/42*** | (2006.01) |
| ***H01Q 21/28*** | (2006.01) |
| ***H01Q 5/40*** | (2015.01) |
| ***H01Q 5/20*** | (2015.01) |
| ***H01Q 5/30*** | (2015.01) |

(Continued)

(52) U.S. Cl.

CPC ..... *H01Q 1/243* (2013.01); *H01Q 1/36* (2013.01); *H01Q 1/48* (2013.01); *H01Q 5/20* (2015.01); *H01Q 5/30* (2015.01); *H01Q 5/35* (2015.01); *H01Q 5/40* (2015.01); *H01Q 5/50* (2015.01); *H01Q 9/0442* (2013.01); *H01Q 9/42* (2013.01); *H01Q 13/10* (2013.01); *H01Q 13/106* (2013.01); *H01Q 21/28* (2013.01)

(58) Field of Classification Search

CPC ..... H01Q 1/243; H01Q 1/48; H01Q 5/20; H01Q 5/30; H01Q 5/35; H01Q 5/40; H01Q 5/50; H01Q 9/0442; H01Q 13/10; H01Q 13/106; H01Q 21/28

See application file for complete search history.

(56) References Cited

U.S. PATENT DOCUMENTS

| | | | |
|---|---|---|---|
| 8,884,835 | B2 | 11/2014 | Pelosi et al. |
| 2003/0164800 | A1 | 9/2003 | Jordan et al. |

(Continued)

FOREIGN PATENT DOCUMENTS

| | | | |
|---|---|---|---|
| CN | 101682119 | A | 3/2010 |
| CN | 102683861 | A | 9/2012 |

(Continued)

*Primary Examiner* — Hoang Nguyen

(74) *Attorney, Agent, or Firm* — Birch, Stewart, Kolasch & Birch, LLP

(57) ABSTRACT

A mobile device includes a metal housing and an antenna structure. A ground plane and a ground branch form at least a portion of the metal housing. The ground branch is coupled to the ground plane. A slot is formed between the ground branch and the ground plane. A circuit element is coupled to the ground branch and the ground plane. The antenna structure is formed by the ground branch. The antenna structure is excited by a signal source.

30 Claims, 8 Drawing Sheets

(51) Int. Cl.

| | |
|---|---|
| ***H01Q 5/35*** | (2015.01) |
| ***H01Q 5/50*** | (2015.01) |
| ***H01Q 1/48*** | (2006.01) |
| ***H01Q 1/36*** | (2006.01) |

(56) References Cited

U.S. PATENT DOCUMENTS

| | | | | |
|---|---|---|---|---|
| 2012/0231750 | A1* | 9/2012 | Jin | H01Q 1/243 455/77 |
| 2014/0062815 | A1 | 3/2014 | Tsai et al. | |
| 2014/0062818 | A1* | 3/2014 | Tsai | H01Q 5/335 343/746 |
| 2014/0071005 | A1 | 3/2014 | Wang | |
| 2014/0266923 | A1 | 9/2014 | Zhou et al. | |
| 2014/0313089 | A1 | 10/2014 | Wu et al. | |
| 2015/0200448 | A1 | 7/2015 | Tsai et al. | |

FOREIGN PATENT DOCUMENTS

| | | | |
|---|---|---|---|
| CN | 203242747 | U | 10/2013 |
| CN | 103682581 | A | 3/2014 |
| CN | 103682583 | A | 3/2014 |
| CN | 103682587 | A | 3/2014 |
| CN | 103811863 | A | 5/2014 |
| CN | 104143701 | A | 11/2014 |
| EP | 2 104 178 | A1 | 9/2009 |
| EP | 2 645 479 | A1 | 10/2013 |
| EP | 2 704 252 | A2 | 3/2014 |
| EP | 2 712 025 | A1 | 3/2014 |
| TW | 201411931 | A | 3/2014 |
| TW | 201414086 | A | 4/2014 |

* cited by examiner

MOBILE DEVICE AND MANUFACTURING METHOD THEREOF

CROSS-REFERENCE OF RELATED APPLICATION

This application is a Continuation of U.S. patent application Ser. No. 14/666,450, filed on Mar. 24, 2015, expressly incorporated herein by reference into the present application.

BACKGROUND OF THE INVENTION

Field of the Invention

The subject application generally relates to a mobile device, and more specifically, to a mobile device and an antenna structure therein.

Description of the Related Art

With the advancement of mobile communication technology, mobile devices such as portable computers, mobile phones, multimedia players, and other hybrid functional portable electronic devices have become more common. To satisfy the demand of users, mobile devices usually can perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2600 MHz. Some devices cover a small wireless communication area; these include mobile phones using Wi-Fi and Bluetooth systems and using frequency bands of 2.4 GHz, 5.2 GHz, and 5.8 GHz.

A mobile phone usually has a limited amount of inner space. However, more and more antennas should be arranged in the mobile phone to operate in different bands. The number of electronic components other than the antennas, in the mobile phone, has not been reduced. Accordingly, each antenna is close to the electronic components, negatively affecting the antenna efficiency and bandwidths thereof.

BRIEF SUMMARY OF THE INVENTION

In a preferred embodiment, the subject application is directed to a mobile device including a ground plane, a ground branch, a supporting element, and a circuit element. The ground branch is coupled to the ground plane. A slot is formed between the ground branch and the ground plane. The supporting element is disposed above the ground branch, and a vertical projection of the supporting element at least partially overlaps the ground branch. The circuit element is coupled between the ground branch and the ground plane. A first antenna structure is formed by the ground branch and excited by a first signal source. A second antenna structure is disposed on the supporting element and is excited by a second signal source.

In some embodiments, the ground branch substantially has an L-shape.

In some embodiments, the slot substantially has a straight-line shape.

In some embodiments, the slot has an open end and a closed end.

In some embodiments, the supporting element is made of a nonconductive material.

In some embodiments, the whole vertical projection of the supporting element is inside the ground branch.

In some embodiments, the mobile device further includes a first matching circuit and a second matching circuit. The first signal source is coupled through the first matching circuit to the first antenna structure. The second signal source is coupled through the second matching circuit to the second antenna structure.

In some embodiments, the circuit element is disposed inside the slot.

In some embodiments, the circuit element is a variable capacitor.

In some embodiments, a capacitance of the variable capacitor is from about 0.5 pF to about 3.3 pF.

In some embodiments, the first antenna structure is used as a reference ground plane of the second antenna structure.

In some embodiments, the second antenna structure includes a first radiation element and a second radiation element. The first radiation element is coupled to the second signal source. The second radiation element is coupled to the ground branch.

In some embodiments, the second antenna structure further includes a first connection element and a second connection element. The first radiation element is coupled through the first connection element to the second signal source. The second radiation element is coupled through the second connection element to the ground branch.

In some embodiments, the first connection element and the second connection element are both substantially perpendicular to the ground branch and the supporting element.

In some embodiments, the first antenna structure operates in a low-frequency band, and the second antenna structure operates in a medium-frequency band and a high-frequency band.

In some embodiments, the low-frequency band is from about 698 MHz to about 960 MHz.

In some embodiments, the medium-frequency band is from about 1710 MHz to about 2170 MHz, and the high-frequency band is from 2300 MHz to 2700 MHz.

In some embodiments, the mobile device further includes one or more electronic components, disposed on the ground branch.

In some embodiments, the electronic components include a speaker, a camera, and/or a headphone jack.

In a preferred embodiment, the subject application is directed to a method for manufacturing a mobile device, including the steps of: providing a ground plane and a ground branch, wherein the ground branch is coupled to the ground plane, and a slot is formed between the ground branch and the ground plane; disposing a supporting element above the ground branch, wherein the vertical projection of the supporting element at least partially overlaps the ground branch; coupling a circuit element between the ground branch and the ground plane; using the ground branch to form a first antenna structure, wherein the first antenna structure is excited by a first signal source; and disposing a second antenna structure on the supporting element, wherein the second antenna structure is excited by a second signal source.

In a preferred embodiment, the subject application is directed to a mobile device including a ground plane, a ground branch, a circuit element, and a switch element. The ground branch is coupled to the ground plane. A slot is formed between the ground branch and the ground plane. The circuit element is coupled between the ground branch and the ground plane. The switch element is coupled between the ground branch and the ground plane. A first antenna structure is formed by the ground branch and excited by a first signal source. A second antenna structure is coupled to the ground branch and excited by a second signal source.

In some embodiments, the second antenna structure is adjacent to an open end of the ground branch.

In some embodiments, the first antenna structure and the second antenna structure are disposed on a same plane.

In some embodiments, the first antenna structure and the second antenna structure are disposed on two respective perpendicular planes.

In some embodiments, the circuit element is disposed at a central portion of the slot.

In some embodiments, the switch element is adjacent to a closed end of the slot.

BRIEF DESCRIPTION OF DRAWINGS

The subject application can be more fully understood by reading the subsequent detailed description and examples with references made to the accompanying drawings, wherein.

DETAILED DESCRIPTION OF THE INVENTION

In order to illustrate the purposes, features and advantages of the subject application, the embodiments and figures of the subject application are shown in detail as follows.

Figure 1:
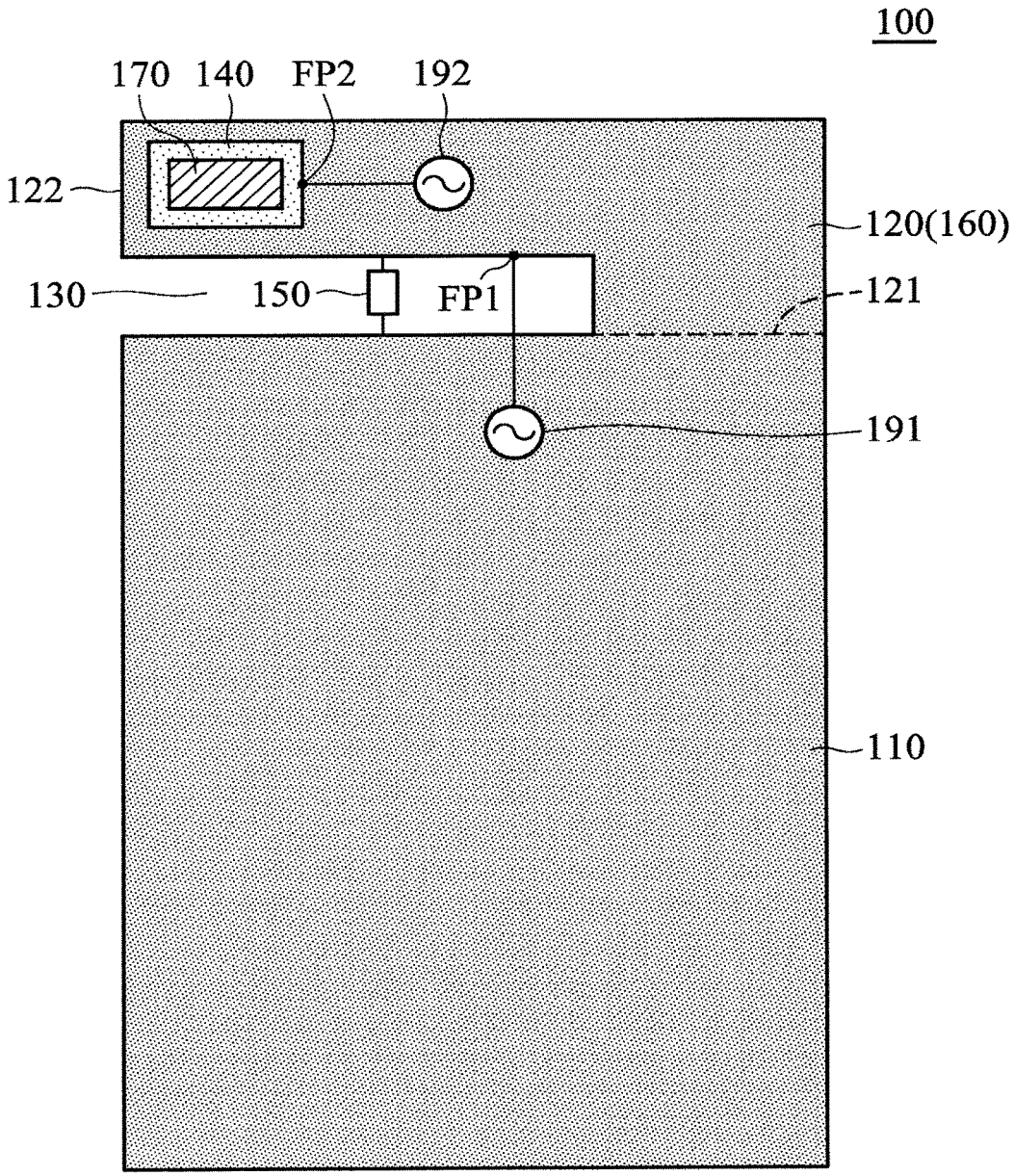
FIG. 1 is a top view of a mobile device according to an embodiment of the subject application.

FIG. 1 is a top view of a mobile device 100 according to an embodiment of the subject application. The mobile device 100 may be a smartphone, a tablet computer, or a notebook computer. As shown in FIG. 1, the mobile device 100 includes a ground plane 110, a ground branch 120, a supporting element 140, a circuit element 150, a first signal source 191, and a second signal source 192. The ground plane 110 and the ground branch 120 may be made of metal materials, such as copper, silver, aluminum, iron, or their alloys. In some embodiments, the ground plane 110 and the ground branch 120 are integrated with a portion of a metal housing of the mobile device 100. The supporting element 140 may be made of a nonconductive material, such as a plastic material or other dielectric materials. The circuit element 150 may be an active element. It should be understood that the mobile device 100 may further include other components, such as a housing, a touch input control module, a display module, an RF (Radio Frequency) module, a processor module, a control module, and a power supply module, etc. (not shown).

The ground branch 120 has a first end 121 and a second end 122. The first end 121 of the ground branch 120 is coupled to a ground plane 110, and the second end 122 of the ground branch 120 is open. A slot 130 is formed between the ground branch 120 and the ground plane 110. The slot 130 has an open end and a closed end. The ground branch 120 may substantially have an L-shape. The slot 130 may substantially have a straight-line shape. The supporting element 140 is disposed above the ground branch 120. A vertical projection of the supporting element 140 at least partially overlaps the ground branch 120. In the embodiment of FIG. 1, the whole vertical projection of the supporting element 140 is inside the ground branch 120. The supporting element 140 may be directly affixed to a surface of the ground branch 120, or the supporting element 140 may be separate from the ground branch 120 and substantially parallel to the ground branch 120. If the supporting element 140 is separate from the ground branch 120, the ground plane 110 and the ground branch 120 may be integrated with a portion (e.g., a back cover) of a metal housing of the mobile device 100, and the supporting element 140 may be integrated with a front sound output element (not shown) (e.g., a sound hole of a speaker, or an earphone) of the mobile device 100, as a portion of a housing.

A first antenna structure 160 is formed by the ground branch 120. A first signal source 191 is coupled to a first feeding point FP1 on the first antenna structure 160, such that the first antenna structure 160 is excited by the first signal source 191. In addition, a second antenna structure 170 is disposed on the supporting element 140. A second signal source 192 is coupled to a second feeding point FP2 on the second antenna structure 170, such that the second antenna structure 170 is excited by the second signal source 192. The first signal source 191 and the second signal source 192 may be two RF (Radio Frequency) modules of the mobile device 100. Generally, the first antenna structure 160 is a PIFA (Planar Inverted F Antenna), but the second antenna structure 170 may be any type. For example, the second antenna structure 170 may be a monopole antenna, a dipole antenna, a loop antenna, a coupling-feed antenna, or a patch antenna, and it may be directly printed on the supporting element 140. The circuit element 150 is coupled between the ground branch 120 and the ground plane 110, and is configured to adjust the impedance matching of the first antenna structure 160 and the second antenna structure 170. The circuit element 150 may be disposed inside the slot 130. In some embodiments, the circuit element 150 is a variable capacitor, such as a varactor diode. A capacitance of the variable capacitor is from about 0.5 pF to about 3.3 pF. The capacitance of the variable capacitor may be adjusted according a control signal. For example, the control signal may be generated by a processor, or by a detector according to the frequency of electromagnetic waves (not shown) detected nearby.

In some embodiments, the first antenna structure 160 operates in a low-frequency band, and the second antenna structure 170 operates in a medium-frequency band and a high-frequency band. For example, the low-frequency band may be from about 698 MHz to about 960 MHz, the medium-frequency band may be from about 1710 MHz to about 2170 MHz, and the high-frequency band may be from 2300 MHz to 2700 MHz. With such a design, the mobile device 100 of the subject application may cover at least the wide frequency bands of LTE B12/B17/B13/B20/GSM850/

900/DCS1800/PCS1900/UMTS and LTE B38/40/41/7. According to practical measurements, the first antenna structure 160 and the second antenna structure 170 may have antenna efficiency which is greater than 50% in the above low-frequency, medium-frequency, and high-frequency bands, and such antenna efficiency can meet the requirements of general mobile communication. The first antenna structure 160 and the second antenna structure 170 can further support CA (Carrier Aggregation) technology.

As to the antenna theory, the first antenna structure 160 (i.e. the ground branch 120) is used as a reference ground plane of the second antenna structure 170. The reference ground plane of the first antenna structure 160 is the ground plane 110. Since the second antenna structure 170 is positioned at a resonator of the first antenna structure 160 and well integrated therewith, the two antenna structures can share the antenna clearance region of the mobile device 100, thereby effectively reducing the total antenna size of the proposed mobile device 100. Furthermore, by appropriately adjusting the impedance value of the circuit element 150, the first antenna structure 160 and the second antenna structure 170 can have different effective ground point and different operation frequency, so as to significantly enhance the isolation between the first antenna structure 160 and the second antenna structure 170. Therefore, the mobile device and the antenna structure of the subject application have at least the advantages of having a small size, wideband operation, and high isolation, and they are suitable for application in a variety of small-sized mobile communication devices.

Figure 2A:
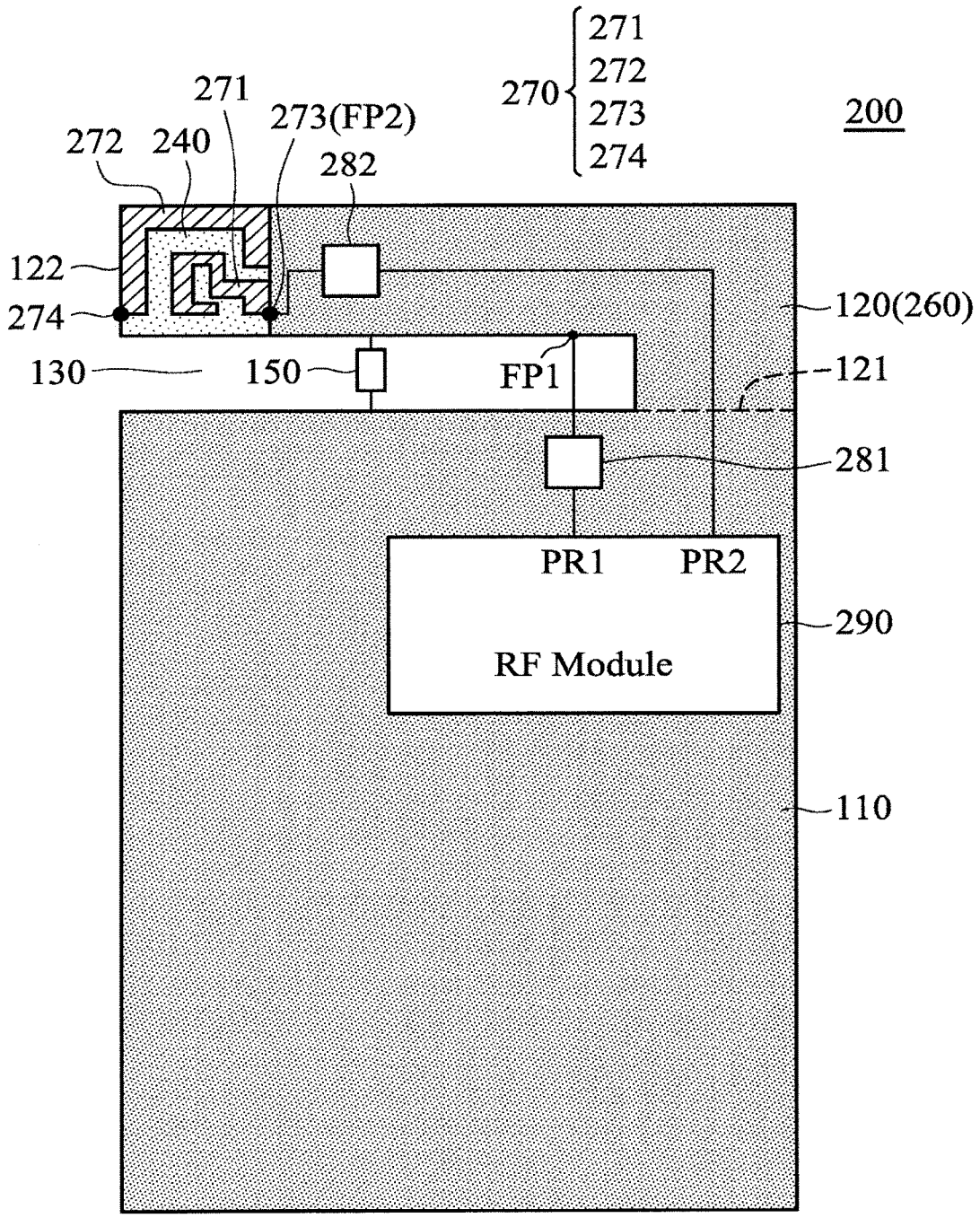
FIG. 2A is a top view of a mobile device according to an embodiment of the subject application.
Figure 2B:
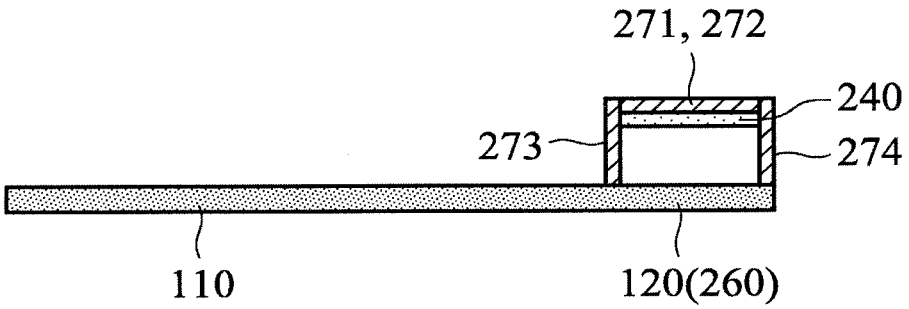
FIG. 2B is a sectional view of a mobile device according to an embodiment of the subject application.

FIG. 2A is a top view of a mobile device 200 according to an embodiment of the subject application. FIG. 2B is a sectional view of the mobile device 200 according to an embodiment of the subject application. Please refer to FIG. 2A and FIG. 2B together. FIG. 2A and FIG. 2B are similar to FIG. 1. In the embodiment of FIG. 2A and FIG. 2B, the mobile device 200 includes a ground plane 110, a ground branch 120, a supporting element 240, a circuit element 150, a first matching circuit 281, a second matching circuit 282, and an RF (Radio Frequency) module 290. The structures and functions of the ground plane 110, the ground branch 120, the supporting element 240, and the circuit element 150 have been discussed in the embodiments of FIG. 1. Similarly, the mobile device 200 also includes a first antenna structure 260 and a second antenna structure 270. The RF module 290 has a first port PR1 and a second port PR2. The first port PR1 of the RF module 290 is coupled through the first matching circuit 281 to a first feeding point FP1 on the first antenna structure 260. The second port PR2 of the RF module 290 is coupled through the second matching circuit 282 to a second feeding point FP2 on the second antenna structure 270. The first port PR1 and the second port PR2 of the RF module 290 are used as the aforementioned first signal source 191 and the second signal source 192, and they are configured to excite the first antenna structure 260 and the second antenna structure 270, respectively, such that the first antenna structure 260 and the second antenna structure 270 can operate in a low-frequency band, a medium-frequency band, and a high-frequency band. The first matching circuit 281 and the second matching circuit 282 may each include one or more capacitors and/or one or more inductors (e.g., chip capacitors and chip inductors), so as to adjust the impedance matching and operation frequency of the first antenna structure 260 and the second antenna structure 270. For example, the first matching circuit 281 and the second matching circuit 282 may each be formed by a capacitor and an inductor coupled in series, or by a capacitor and an inductor coupled in parallel. It should be understood that the subject application is not limited to the above examples.

In the embodiment of FIG. 2A and FIG. 2B, the first antenna structure 260 is a PIFA, and the second antenna structure 270 is a coupling-feed antenna. Specifically, the second antenna structure 270 includes a first radiation element 271, a second radiation element 272, a first connection element 273, and a second connection element 274. The first radiation element 271 is separate from the second radiation element 272. The first radiation element 271 is coupled through the first connection element 273 to the second port PR2 of the RF module 290. The second radiation element 272 is coupled through the second connection element 274 to the ground branch 120. As shown in FIG. 2B, the first connection element 273 and the second connection element 274 are both substantially perpendicular to the ground branch 120 and the supporting element 240. Each of the first connection element 273 and the second connection element 274 may be a pogo pin or a metal spring. The second radiation element 272 is disposed adjacent to the first radiation element 271, and is excited by the first radiation element 271 through a mutual coupling mechanism. The first radiation element 271 may substantially be shaped like a question mark. The second radiation element 272 may substantially have a J-shape. The first radiation element 271 and the second radiation element 272 are completely separate from each other. In alternative embodiments, any one of the first radiation element 271 and the second radiation element 272 has a different shape, such as a straight-line shape, an L-shape, an F-shape, or an S-shape, and the first radiation element 271 and the second radiation element 272 may be coupled to each other. Other features of the mobile device 200 of FIG. 2A and FIG. 2B are similar to those of the mobile device 100 of FIG. 1. Accordingly, the two embodiments can achieve similar levels of performance.

Figure 3:
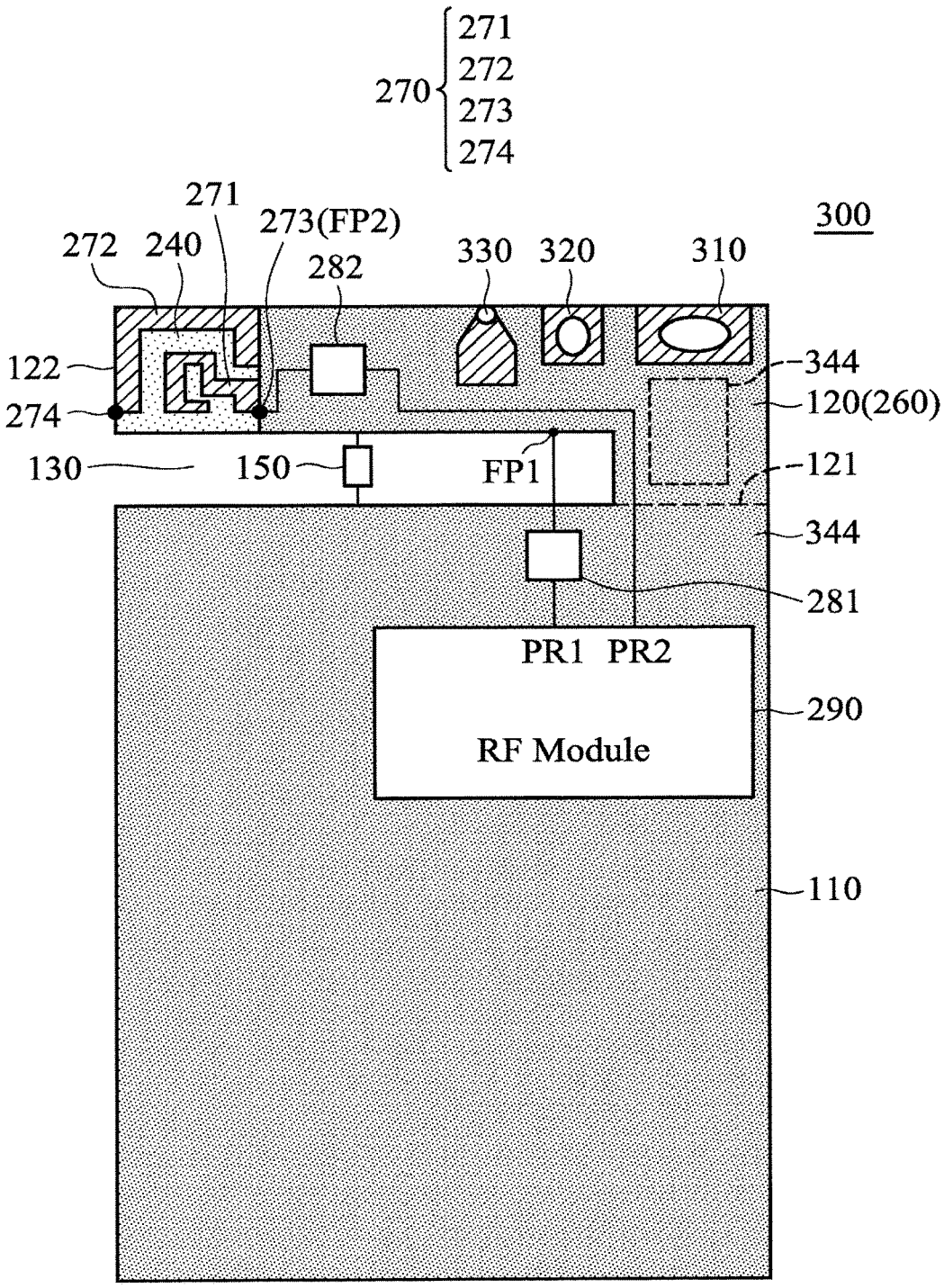
FIG. 3 is a top view of a mobile device according to an embodiment of the subject application.

FIG. 3 is a top view of a mobile device 300 according to an embodiment of the subject application. FIG. 3 is similar to FIG. 2. In the embodiment of FIG. 3, the mobile device 300 further includes one or more electronic components, such as a speaker 310, a camera 320, and/or a headphone jack 330. The electronic components are disposed on a first antenna structure 260 (i.e., the ground branch 120) of the mobile device 300, and may be used as a portion of the first antenna structure 260. Accordingly, the electronic components do not influence the radiation performance of the first antenna structure 260 very much. In this embodiment, the first antenna structure 260 may load the electronic components and may be appropriately integrated with them, thereby reducing the use of the inner design space of the mobile device 300. It should be noted that the electronic components may be coupled through a wiring region 344 to a processor module and a control module (not shown) of the mobile device 300. Other features of the mobile device 300 of FIG. 3 are similar to those of the mobile device 200 of FIG. 2. Accordingly, the two embodiments can achieve similar levels of performance.

Figure 4A:
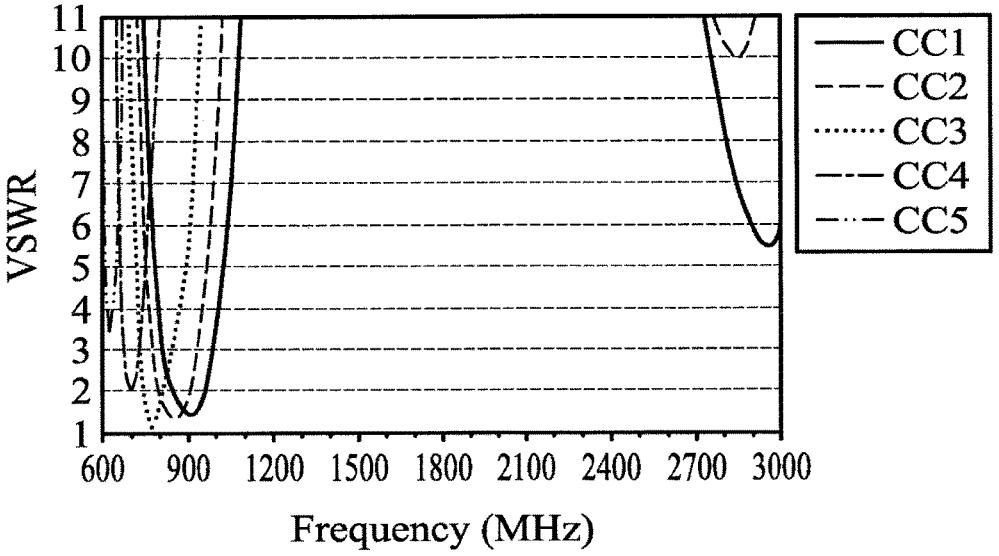
FIG. 4A is a diagram of a VSWR (Voltage Standing Wave Ratio) of a first antenna structure of a mobile device according to an embodiment of the subject application.
Figure 4B:
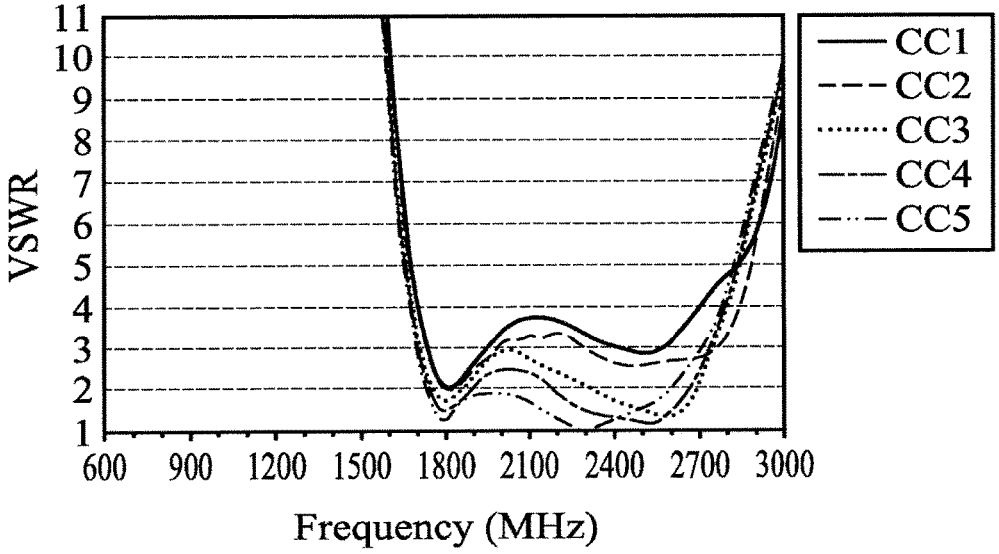
FIG. 4B is a diagram of a VSWR of a second antenna structure of a mobile device according to an embodiment of the subject application.

FIG. 4A is a diagram of a VSWR (Voltage Standing Wave Ratio) of the first antenna structure 260 of the mobile device 200 according to an embodiment of the subject application. FIG. 4B is a diagram of a VSWR of the second antenna structure 270 of the mobile device 200 according to an embodiment of the subject application. Please refer to FIG. 4A and FIG. 4B together. The horizontal axis represents the operation frequency (MHz), and the vertical axis represents the VSWR. A first curve CC1 represents the characteristic of the above antenna structures when the circuit element 150 has a capacitance of 0.75 pF. A second curve CC2 represents the characteristic of the above antenna structures when the circuit element 150 has a capacitance of 1 pF. A third curve CC3 represents the characteristic of the above antenna structures when the circuit element 150 has a capacitance of 1.5 pF. A fourth curve CC4 represents the characteristic of the above antenna structures when the circuit element 150 has a capacitance of 2.2 pF. A fifth curve CC5 represents the characteristic of the above antenna structures when the circuit element 150 has a capacitance of 3.3 pF. According to the measurement of FIG. 4A and FIG. 4B, when the capacitance of the circuit element 150 is increased, the operation band of the first antenna structure 260 may shift to the low-frequency region; and when the capacitance of the circuit element 150 is decreased, the operation band of the first antenna structure 260 may shift to the high-frequency region. On the other hand, the change of the capacitance of the circuit element 150 has little impact on the second antenna structure 270. Therefore, by appropriately controlling the impedance value of the circuit element 150, the mobile device 200 of the subject application can achieve multi-band operations and wideband operations, without changing the total size of the antenna structures.

Figure 5:
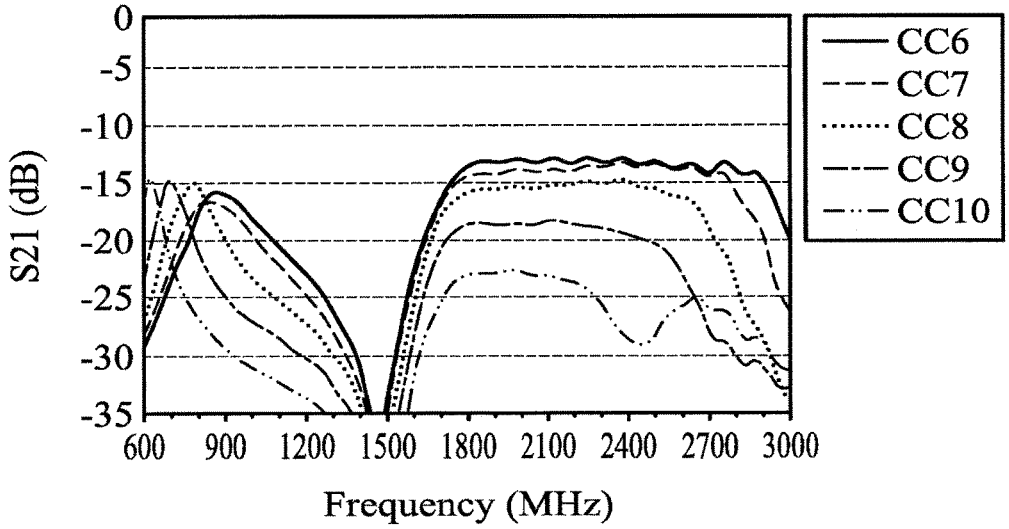
FIG. 5 is a diagram of isolation between a first antenna structure and a second antenna structure of a mobile device according to an embodiment of the subject application.

FIG. 5 is a diagram of isolation between the first antenna structure 260 and the second antenna structure 270 of the mobile device 200 according to an embodiment of the subject application. The horizontal axis represents the operation frequency (MHz), and the vertical axis represents the isolation (S21) (dB). A sixth curve CC6 represents the characteristic of the above isolation when the circuit element 150 has a capacitance of 0.75 pF. A seventh curve CC7 represents the characteristic of the above isolation when the circuit element 150 has a capacitance of 1 pF. An eighth curve CC8 represents the characteristic of above isolation when the circuit element 150 has a capacitance of 1.5 pF. A ninth curve CC9 represents the characteristic of the above isolation when the circuit element 150 has a capacitance of 2.2 pF. A tenth curve CC10 represents the characteristic of the above isolation when the circuit element 150 has a capacitance of 3.3 pF. According to the measurement of FIG. 5, when the capacitance of the circuit element 150 is increased, the isolation between the first antenna structure 260 and the second antenna structure 270 is improved; and when the capacitance of the circuit element 150 is decreased, the isolation between the first antenna structure 260 and the second antenna structure 270 is reduced. Accordingly, by appropriately controlling the impedance value of the circuit element 150, the mobile device 200 of the subject application can enhance the isolation between the first antenna structure 260 and the second antenna structure 270, thereby eliminating signal transmission interference. In alternative embodiments, when the circuit element 150 is moved toward the left open end of the slot 130, the isolation between the first antenna structure 260 and the second antenna structure 270 may be enhanced further, in particular to the medium-frequency band and the high-frequency band.

Figure 6:
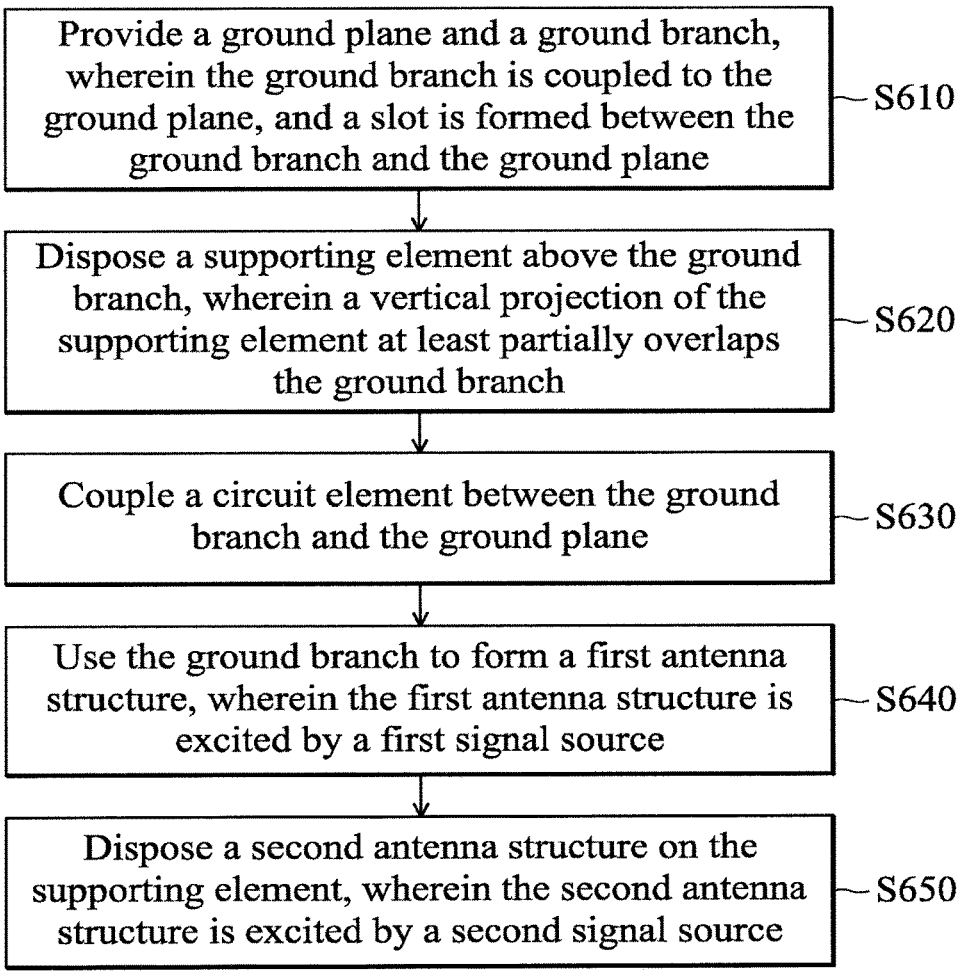
FIG. 6 is a flowchart of a method for manufacturing a mobile device according to an embodiment of the subject application.

FIG. 6 is a flowchart of a method for manufacturing a mobile device according to an embodiment of the subject application. The manufacturing method may include the following steps. In step S610, a ground plane and a ground branch are provided. The ground branch is coupled to the ground plane. A slot is formed between the ground branch and the ground plane. In step S620, a supporting element is disposed above the ground branch. A vertical projection of the supporting element at least partially overlaps the ground branch. In step S630, a circuit element is coupled between the ground branch and the ground plane. In step S640, the ground branch is used to form a first antenna structure. The first antenna structure is excited by a first signal source. In step S650, a second antenna structure is disposed on the supporting element. The second antenna structure is excited by a second signal source. It should be understood that the above steps are not required to be performed sequentially, and any one or more features of any one or more embodiments of FIGS. 1-5 may be applied to the manufacturing method of FIG. 6.

Figure 7:
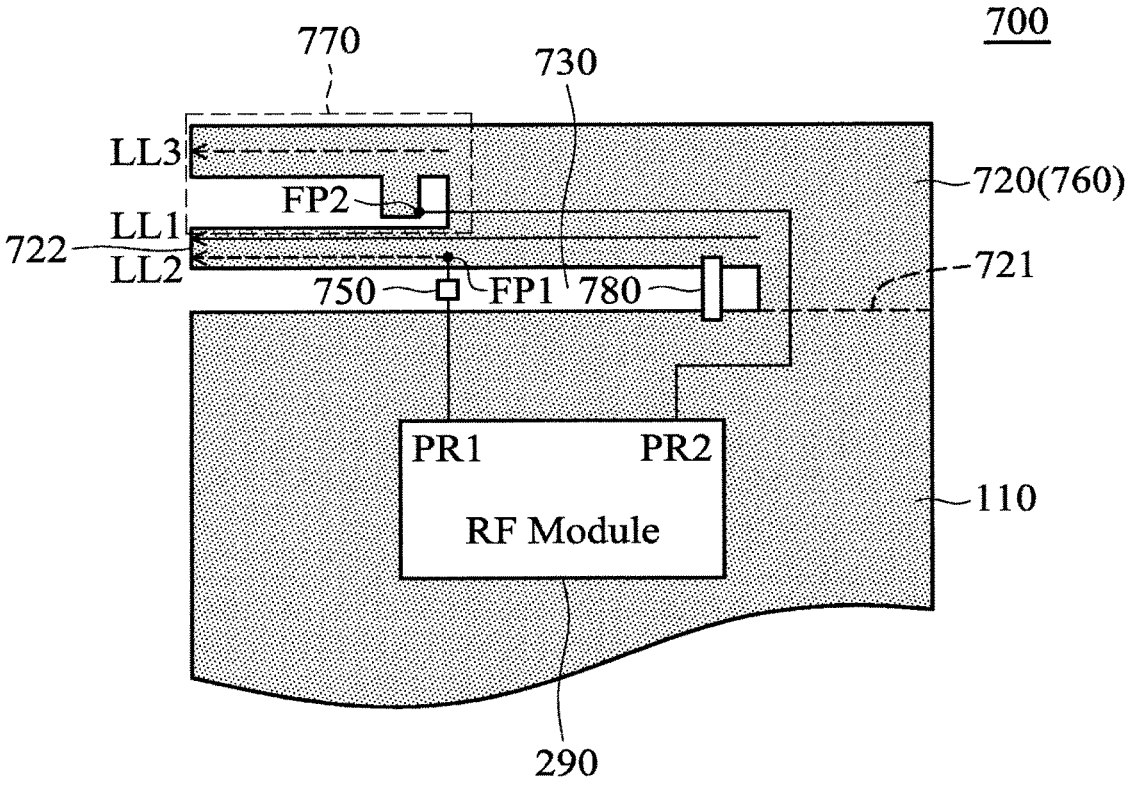
FIG. 7 is a top view of a mobile device according to an embodiment of the subject application.

FIG. 7 is a top view of a mobile device 700 according to an embodiment of the subject application. FIG. 7 is similar to FIG. 2A and FIG. 2B. In the embodiment of FIG. 7, the mobile device 700 includes a ground plane 110, a ground branch 720, a circuit element 750, a switch element 780, and an RF module 290. The ground branch 720 has a first end 721 and a second end 722. The first end 721 of the ground branch 720 is coupled to the ground plane 110, and the second end 722 of the ground branch 720 is open. A slot 730 is formed between the ground branch 720 and the ground plane 110. The slot 730 has an open end and a closed end. The circuit element 750 is coupled between the ground branch 720 and the ground plane 110. The circuit element 750 may be a variable capacitor. The circuit element 750 may be disposed at a central portion of the slot 730. The switch element 780 is coupled between the ground branch 720 and the ground plane 110. The switch element 780 may be adjacent to a closed end of the slot 730. A first antenna structure 760 is formed by the ground branch 720. The first antenna structure 760 is excited by a first port PR1 of the RF module 290 through the circuit element 750. A second antenna structure 770 is coupled to the ground branch 720. The second antenna structure 770 is excited by a second port PR2 of the RF module 290. The second antenna structure 770 is disposed adjacent to the second end 722 of the ground branch 720. Specifically, the second end 722 of the ground branch 720 may have a corner notch, and the second antenna structure 770 may include a T-shaped or straight-line-shaped radiator disposed in the corner notch. In the embodiment of FIG. 7, the first antenna structure 760 is used as a reference ground plane of the second antenna structure 770. In some embodiments, the first antenna structure 760 operates in a low-frequency band and a medium-frequency band, and the second antenna structure 770 operates in a high-frequency band. For example, the low-frequency band may be from about 698 MHz to about 960 MHz, the medium-frequency band may be from about 1710 MHz to about 2170 MHz, and the high-frequency band may be from 2300 MHz to 2700 MHz. By operating the switch element 780 in a closed state or an open state, and changing the variable capacitance of the circuit element 750, the first antenna structure 760 and the second antenna structure 770 can generate three different resonant paths LL1, LL2, and LL3, so as to respectively cover the low-frequency band, medium-frequency band, and high-frequency band above. In the embodiment of FIG. 7, the first antenna structure 760 and the second antenna structure 770 are disposed on the same plane, but the subject application is not limited thereto. In other embodiments, the first antenna structure 760 and the second antenna structure 770 may be disposed at two respective perpendicular planes. For example, the first antenna structure 760 may be formed on a back cover of a mobile device, and the second antenna structure 770 may be formed on a top cover of the mobile device (not shown). The back cover and the top cover may be perpendicular to each other. Other features of the mobile device 700 of FIG. 7 are similar to those of the mobile device 200 of FIG. 2A and FIG. 2B. Accordingly, the two embodiments can achieve similar levels of performance.

It should be noted that the above element shapes, element parameters, and frequency ranges are not limitations of the subject application. An antenna designer can fine-tune these settings or values according to different requirements. The mobile device and antenna structure of the subject application are not limited to the configurations of FIGS. 1-7. The subject application may merely include any one or more features of any one or more embodiments of FIGS. 1-7. In other words, not all of the features displayed in the figures should be implemented in the mobile device and antenna structure of the subject application.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for the ordinal term) to distinguish the claim elements.

The embodiments of the disclosure are considered as exemplary only, not limitations. It will be apparent to those skilled in the art that various modifications and variations can be made in the subject application, the true scope of the disclosed embodiments being indicated by the following claims and their equivalents.

What is claimed is:

1. A mobile device, comprising:

a metal housing;

a substrate, having a first ground plane;

a first antenna structure, having a ground branch, wherein the ground branch is coupled to the first ground plane, a slot is formed between the ground branch and the first ground plane, at least one portion of the metal housing is formed by the first ground plane and the ground branch, and the first antenna structure is excited by a first signal source; and a circuit element, electrically coupled to the ground branch and the first ground plane.

2. The mobile device as claimed in claim 1, further comprising:

a supporting element, disposed above the ground branch, wherein a vertical projection of the supporting element at least partially overlaps the ground branch.

3. The mobile device as claimed in claim 2, wherein a second antenna structure, having a second ground plane, is disposed on the supporting element and excited by a second signal source.

4. The mobile device as claimed in claim 3, further comprising:

a first matching circuit, wherein the first signal source is electrically coupled through the first matching circuit to the first antenna structure; and a second matching circuit, wherein the second signal source is electrically coupled through the second matching circuit to the second antenna structure.

5. The mobile device as claimed in claim 3, wherein the ground branch of the first antenna structure is used as the second ground plane of the second antenna structure.

6. The mobile device as claimed in claim 3, wherein the second antenna structure comprises:

a first radiation element, electrically coupled to the second signal source; and a second radiation element, electrically coupled to the ground branch.

7. The mobile device as claimed in claim 6, wherein the second antenna structure further comprises:

a first connection element, wherein the first radiation element is electrically coupled through the first connection element to the second signal source; and a second connection element, wherein the second radiation element is electrically coupled through the second connection element to the ground branch.

8. The mobile device as claimed in claim 7, wherein the first connection element and the second connection element are both substantially perpendicular to the ground branch and the supporting element.

9. The mobile device as claimed in claim 3, wherein the first antenna structure operates in a low-frequency band, and the second antenna structure operates in a medium-frequency band and a high-frequency band.

10. The mobile device as claimed in claim 9, wherein the low-frequency band is from about 698 MHz to about 960 MHz.

11. The mobile device as claimed in claim 9, wherein the medium-frequency band is from about 1710 MHz to about 2170 MHz, and the high-frequency band is from 2300 MHz to 2700 MHz.

12. The mobile device as claimed in claim 2, wherein the supporting element is made of a nonconductive material.

13. The mobile device as claimed in claim 2, wherein the whole vertical projection of the supporting element is inside the ground branch.

14. The mobile device as claimed in claim 2, wherein the supporting element is integrated with a front sound output element of the mobile device, so as to form another portion of the metal housing.

15. The mobile device as claimed in claim 14, wherein at least one back portion of the metal housing is formed by the first antenna structure.

16. The mobile device as claimed in claim 1, wherein the ground branch substantially has an L-shape.

17. The mobile device as claimed in claim 1, wherein the slot substantially has a straight-line shape.

18. The mobile device as claimed in claim 1, wherein the slot has an open end and a closed end.

19. The mobile device as claimed in claim 1, wherein at least one portion of the back cover of the metal housing is formed by the first antenna structure.

20. The mobile device as claimed in claim 1, wherein the circuit element is a variable capacitor.

21. The mobile device as claimed in claim 20, wherein a capacitance of the variable capacitor is from about 0.5 pF to about 3.3 pF.

22. The mobile device as claimed in claim 1, further comprising:

one or more electronic components, electrically connected to the ground branch.

23. The mobile device as claimed in claim 22, wherein the electronic components comprise a speaker, a camera, and/or a headphone jack.

24. The mobile device as claimed in claim 1, further comprising:

a switch element, electrically coupled to the ground branch and the first ground plane.

25. The mobile device as claimed in claim 24, wherein the first antenna structure is excited through the circuit element by the first signal source, and a second antenna structure is electrically coupled to the first ground plane and excited by a second signal source.

26. The mobile device as claimed in claim 25, wherein the second antenna structure is adjacent to an open end of the ground branch.

27. The mobile device as claimed in claim 25, wherein the first antenna structure and the second antenna structure are disposed on the same plane.

28. The mobile device as claimed in claim 25, wherein the second antenna structure and at least one portion of the first antenna structure are disposed on two respective perpendicular planes.

29. The mobile device as claimed in claim 28, wherein the second antenna structure and at least one portion of the first antenna structure are disposed on a top cover of the metal housing of the mobile device.

30. The mobile device as claimed in claim 25, wherein the first antenna structure operates in a low-frequency band and a medium-frequency band, and the second antenna structure operates in a high-frequency band.

* * * * *